US009016979B1

(12) United States Patent
Coppes et al.

(10) Patent No.: US 9,016,979 B1
(45) Date of Patent: Apr. 28, 2015

(54) PLASTIC STORMWATER CHAMBER MADE FROM SEPARATELY MOLDED HALF CHAMBERS

(71) Applicants: Bryan A. Coppes, Old Saybrook, CT (US); Paul R. Holbrook, Old Saybrook, CT (US); Brian M. Burnes, Bristol, CT (US)

(72) Inventors: Bryan A. Coppes, Old Saybrook, CT (US); Paul R. Holbrook, Old Saybrook, CT (US); James Burnes, Deep River, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 0 days.

(21) Appl. No.: 14/025,782

(22) Filed: Sep. 12, 2013

Related U.S. Application Data

(60) Provisional application No. 61/700,313, filed on Sep. 12, 2012.

(51) Int. Cl.
*E02B 11/00* (2006.01)
*E01F 5/00* (2006.01)

(52) U.S. Cl.
CPC ..... *E02B 11/005* (2013.01); *E01F 5/00* (2013.01)

(58) Field of Classification Search
USPC ..... 405/36, 46, 49; 210/170.08; 137/236.1
See application file for complete search history.

(56) References Cited

U.S. PATENT DOCUMENTS

| | | | | |
|---|---|---|---|---|
| 770,236 | A | 9/1904 | Luridtzen | |
| 1,052,198 | A | 2/1913 | Wyre | |
| 4,245,924 | A | 1/1981 | Fouss | |
| 6,205,605 | B1 | 3/2001 | Orsat | |
| 6,311,734 | B1 | 11/2001 | Petrovic | |
| 6,364,575 | B1 | 4/2002 | Bradley | |
| 6,743,360 | B2 | 6/2004 | Peterson | |
| 6,991,734 | B1 | 1/2006 | Smith et al. | |
| 7,118,306 | B2 | 10/2006 | Kruger et al. | |
| 8,070,005 | B1 * | 12/2011 | Kruger et al. | 220/4.13 |
| 8,491,224 | B2 | 7/2013 | Cobb et al. | |
| 8,672,583 | B1 | 3/2014 | Mailhot et al. | |

* cited by examiner

*Primary Examiner* — Tara M. Pinnock
(74) *Attorney, Agent, or Firm* — C. Nessler

(57) ABSTRACT

A molded plastic arch shape cross section stormwater chamber having a corrugated wall comprises separately molded half chambers which are connected by coupling features at a joint at the top of the chamber. Preferably, the half chambers are substantially identical and are made in the same mold. The half chambers may be compactly stored and transported. Near the point of use, the chambers may be assembled.

20 Claims, 5 Drawing Sheets

PLASTIC STORMWATER CHAMBER MADE FROM SEPARATELY MOLDED HALF CHAMBERS

This application claims benefit of provisional patent application Ser. No. 61/700,313, filed Sep. 12, 2012.

TECHNICAL FIELD

The present invention relates to molded plastic chambers having arch shape cross sections, for receiving, containing and dispersing stormwater when buried beneath the surface of the earth.

BACKGROUND

Arch shape cross section storm chambers made from injection molded plastics have been used for a number of years to handle stormwater. In a typical installation, multiple rows of strings of interconnected chambers are placed on the floor of a cavity made in the earth surface and are then backfilled with crushed stone or the like. Stormwater, such as might run-off from a paved parking lot or roofs of buildings is channeled to the chambers so the waters can accumulate and then be dispersed over time by either percolation into the surrounding soil or by controllably flowing to a water course.

Some types of arch shape cross section chambers, exemplified by a corrugated chamber described in Detullio U.S. Pat. No. 5,087,151, have closed ends and are interconnected by pipes. Those chambers might be made by thermoforming of thermoplastic sheet. Another type of chamber, of more relevance to the invention described herein, is exemplified by the chambers shown in Kruger U.S. Pat. No. 7,118,306. Those kinds of chambers are preferably made by injection molding. The chambers have open ends. A string of chambers is assembled by overlapping a first end of one chamber on the second end of a like chamber, when the like chamber has been previously placed within a cavity in the earth. After installation, the chambers are backfilled, typically with crushed stone, and the stone is covered to create a soil surface, often a paved surface which can be used by motor vehicles.

When so installed beneath the surface of the earth, stormwater chambers should have requisite strength and durability, particularly for bearing the overlying load of soil and any vehicular or other traffic.

Systems comprised of molded plastic arch shape cross section stormwater chambers are in functional- and cost-competition with other stormwater systems, including buried systems comprised of steel conduit and detention ponds. Generally, it is an objective to have storm chambers with larger and larger volumetric capacity per unit length, while of course still meeting the load bearing requirements. Whereas early plastic chambers used 20 years or more ago had a peak height of 12 inches, more recent chambers may be quite large. For example, a commercial Model 4500 stormwater chamber sold by Stormtech LLC, Rocky Hill, Conn. is 100 inches wide at the base, about 60 inches high, about 48 inches long, and weighs about 120 pounds. There is a generalized desire to commercialize even larger chambers.

There are practical problems encountered with large chambers. Among them are: First, it is not easy to mold large chambers because they require large molding machines and machinery for handling the just-molded products. Large and thus less common injection molding machines can be costly.

Second, large chambers present problems with respect to storing and shipping in economic fashion by truck —the most common mode. Typically chambers are nested one within the other to form a stack for shipment on pallet. But the basic height of a chamber is large to begin with, then that means not many chambers can be nested before the height capacity of a ordinary highway truck is exceeded. For example, if the load height capacity of a truck is about 100 inches from the bed surface, and one chamber is 60 inches high, then there is only an about 40 inches of space for containing nested chambers. If the stack height is about 6 inches (the spacing between one chamber and next-nested chamber), then only 6-7 chambers can be stacked on top of the bottom chamber.

Third, the weight of each individual chamber can exceed that which workers can handle manually, particularly at the site where the stormwater system is being constructed, necessitating the use of materials handling equipment. It is more convenient for installers to not have to use lifting devices.

SUMMARY

An object of the invention is to provide large stormwater chambers which have improved characteristics with respect to manufacturability, shipment and handling. Another object is to provide a chamber and associated handling shipping method which minimizes storage and shipping costs.

In accord with the present invention, a stormwater chamber is comprised of two half chambers. Half chambers of the present invention may be stacked as a nested multiplicity of half chambers on a pallet or the like for economical shipping, particularly by means of a motor vehicle transport truck. At or near the point of use, the half chambers are mated at coupling features to form a chamber which is in use configuration and which has a joint at the top of the chamber. Preferably, the half chambers are substantially identical and are made in the same mold.

Different embodiments of coupling features and joints may be used. Typically the joint is comprised of mating flanges, intermittent or continuous, which run along the length of the top of the chamber. The flanges may interlock, Clamps and latching means may be used to hold the half chambers relative to each other while they are handled and until they are buried in soil or the like for use.

The foregoing and other objects, features and advantages of the present invention will become more apparent from the following description of preferred embodiments and accompanying drawings.

DESCRIPTION

Embodiments of chambers of the present invention are preferably made of injection molded thermoplastic, preferably a polyolefin such as polyethylene or polypropylene. Exemplary chambers are comprised of half chambers which join to each other by coupling means at a joint proximate the top of the chamber.

Figure 1:
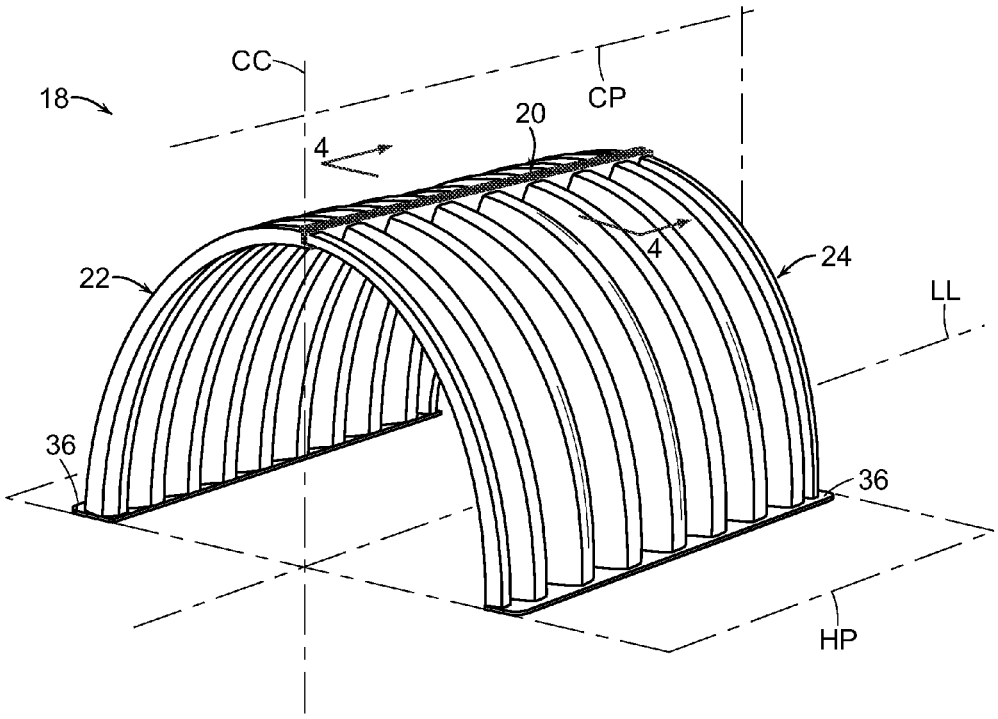
FIG. 1 is a perspective view of a stormwater chamber comprised of half chambers mated at a top joint.
Figure 2:
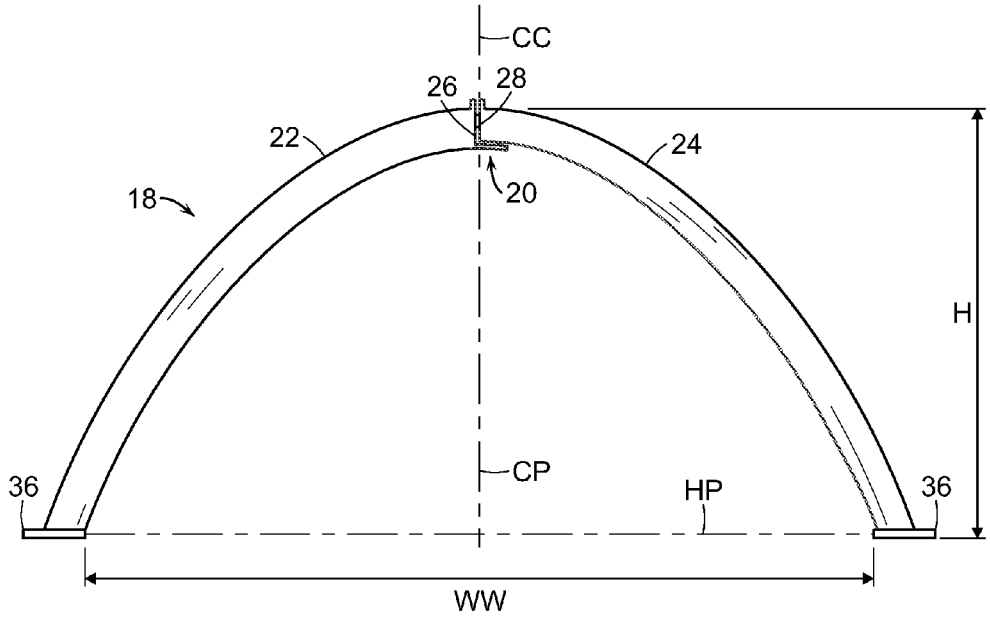
FIG. 2 is an end view of the chamber of FIG. 1.

FIG. 1 is a perspective view and FIG. 2 is an end elevation view of a chamber 18 in its use configuration. The chamber is comprised of two mated chamber halves 22, 24 which have a joint 20 and opposing side base flanges 36 which lie in base plane HP. Chamber 18 has a length axis LL and a vertical lengthwise center plane CP which contains a vertical axis C, used as a reference in other Figures.

Figure 3:
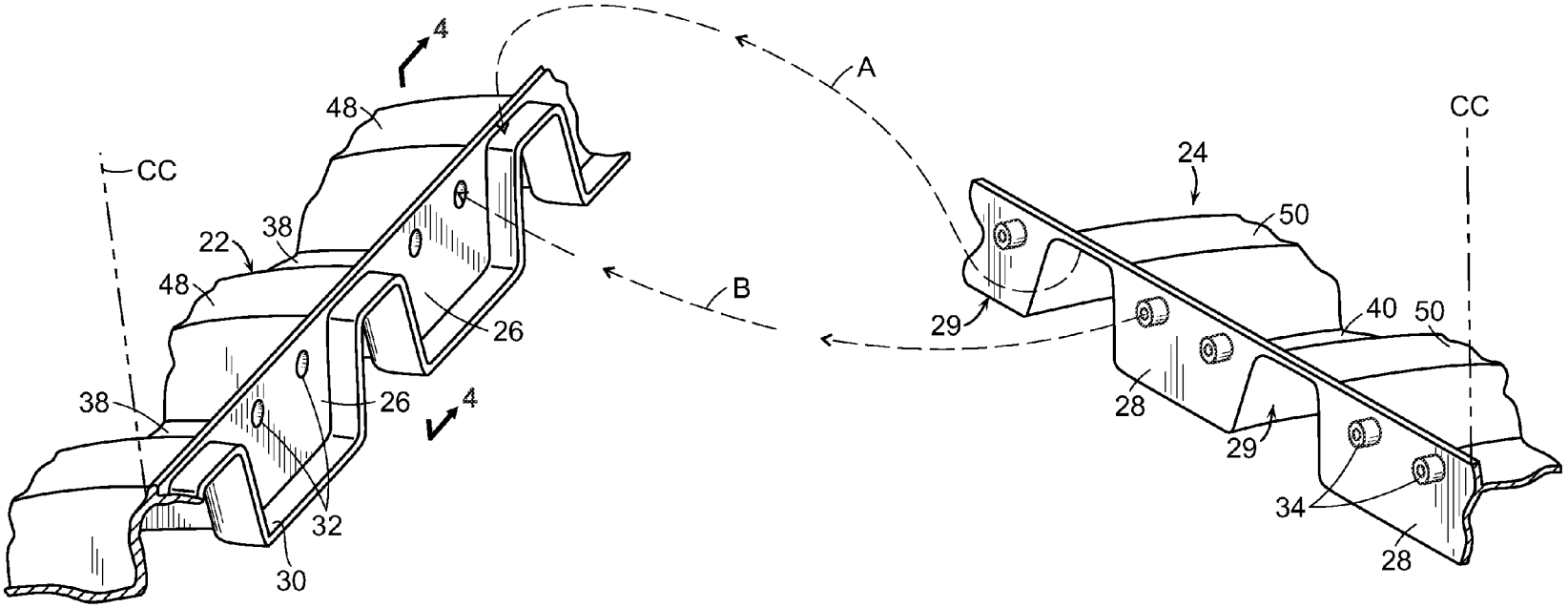
FIG. 3 is an exploded view showing the upper portions of two half chambers which comprise a chamber like that shown in FIG. 1, showing how the half chambers couple to each other at a joint at the top of the chamber.

FIG. 3 is an exploded view showing how the upper portions of exemplary half chambers 22, 24 couple together. FIGS. 4, 5, 6 and 9 are partial transverse cross section views showing features of joints of alternative embodiment chambers. An exemplary thermoplastic chamber will have a width WW of about 100 inches, a height H of about 60 inches, and a length of about 52 inches (so the effective length is 48 inches when the chambers are end to end overlapped). Alternating peak corrugations 48, 50 and valley corrugations 38, 40 run transverse to the length of the chamber. The corrugations provide cross section area for vertical load transfer and section modulus which imparts bending strength to the walls. Below, the terms "valley" and "peak" are shorthand references to the valley corrugations and peak corrugations.

Stormwater chambers and their use have been described in the art. In particular, reference may be made to commonly owned U.S. Pat. No. 7,118,306 of Kruger et al., entitled "Stormwater Management System" and U.S. Pat. No. 6,991,734 of Smith et al, entitled "Solids Retention in Stormwater System." The disclosures of the foregoing patents are hereby incorporated by reference. When a chamber is buried within crushed stone or other soil material the arch shape of the chamber cross section maintains the integrity of the interior cavity of the chamber. Simply stated, the vertical forces of the stone, soil, and anything on the surface of the soil, are transferred along the curve of the arch to the base flanges. As is characteristic of arches (for instance, arches comprised of stone or brick pieces), there need not be significant capacity to bear shear forces within the curved structure in order to maintain the integrity of the structure once it is in place and subjected to foregoing kind of vertical loads. Thus, it will be appreciated that in the present invention the joint 20 at the top of the chamber need not have strength to resist high shear load. However, a joint will desirably have sufficient shear strength to enable lifting and other handling of a chamber, to move it from the point of assembly to its position within a to-be-filled cavity in the earth.

In one embodiment, half chambers are mechanically interlocked and optionally welded or otherwise secured at coupling features in vicinity of the joint. When the joint is planar it is preferably in the vertical center plane CP. When the joint is non-planar, the joint will be in proximity of the vertical center plane, with parts of the joint somewhat offset from the plane.

FIG. 3 shows the top portions of the two half chambers 22, 24, as they appear when spaced apart and rotated away from each other to reveal the coupling features. Arrows A, B show how the half chambers 22, 24 mate with each other when the coupling surfaces are brought together to form a joint. The top of half chamber 22, on the left, has a serpentine lip 30 and a discontinuous vertical top flange 26. The flange 26 is comprised of a plurality of flat plates which close the ends of the valleys 38 that are between adjacent peak corrugations 48. The lip 30 is shaped to mate with the serpentine interior surface 29 of the half chamber 24, on the right in FIG. 3. Half chamber 24 has a top flange 28 lying in or close to the vertical plane CP which contains a vertical reference axis CC. See FIG. 1. Flanges 26, 28 may be discontinuous as shown, comprising a plurality of flat plates closing off the ends of the valleys. In an alternative embodiment flanges 26, 28 are continuous along the length of the top of each half chamber and close the underside cavity of the peak corrugations. See FIG. 7.

When half chamber 22 and half chamber 24 are engaged with each other, the upper end of half chamber 24 rests on the surface of the serpentine lip 30. Flange 28 has a multiplicity of horizontally extending pins 34 which fit into the female cavities of sockets 32 on the flange 26, to help align the coupling features with each other. The pin-socket engagements provide some shear strength to the joint.

Figure 4:
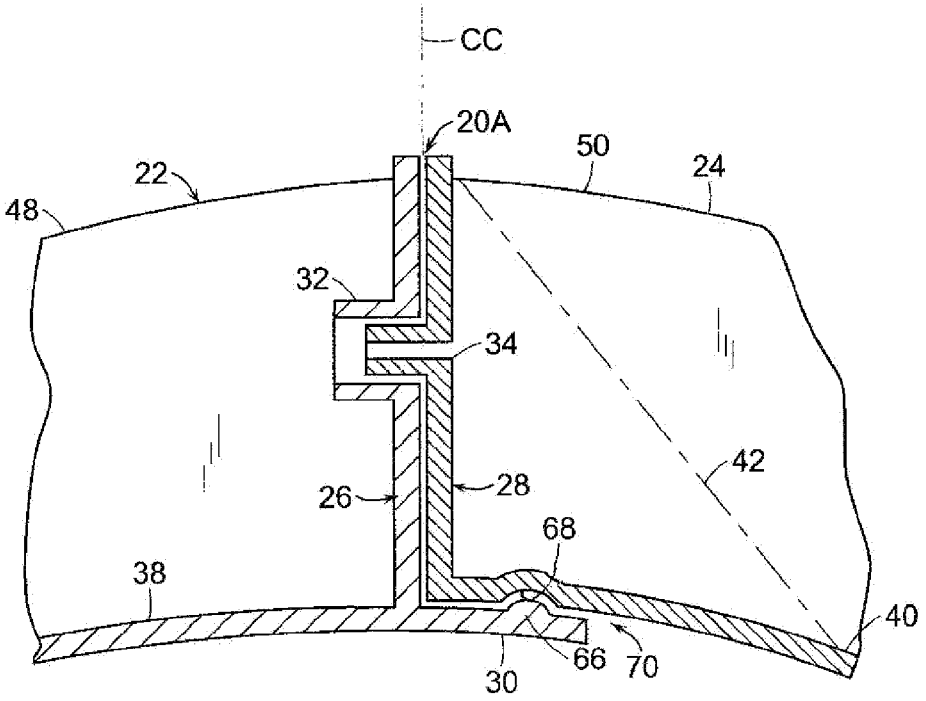
FIG. 4 is a vertical transverse cross section through the top portion of the chamber of FIG. 1.

FIG. 4 is a transverse vertical cross section showing portions of half chambers 22, 24 when they are mated to form a chamber 18 as shown in FIG. 2. The parts are shown as they are ready for welding, as by ultrasonic, heat gun, hot plate, or other known means, for example at joints 70, 20A. Note how typical valley 40 of half 24 rests on lip 30 of half 22. The engagement of the vertical flange 26 on one half chamber with the vertical flange 28 on a mating half chamber is helped by pins 34 and sockets 32, or by means of substitutional functionally-equivalent features. The pins and socket features help locate the mating half chambers with respect to each other and also provide some vertical direction strength to the joint.

Optionally, as shown in FIG. 4, lip 30 (which has the ability to elastically deflect downwardly) may have a lengthwise ridge or a series of upward projecting protuberances 66 which are received in mating recesses 68 on the undersides of typical valleys 40, to modestly hold the half chambers together at the joint prior to welding.

While welding is preferred with the FIG. 4 joint design, it is within contemplation that chambers having joints like those shown in FIG. 4 may be useful for assembling chambers at the point of installation without adding the welding step. Other fastening or securing means may be used with the FIG. 4 embodiment, as described below.

FIG. 4 also shows in phantom one of several optional stiffeners 42 which may be molded into the center one or more valleys 40 of typical half chamber part 24. Like stiffeners may be used on the other half 22, as well.

Figure 5:
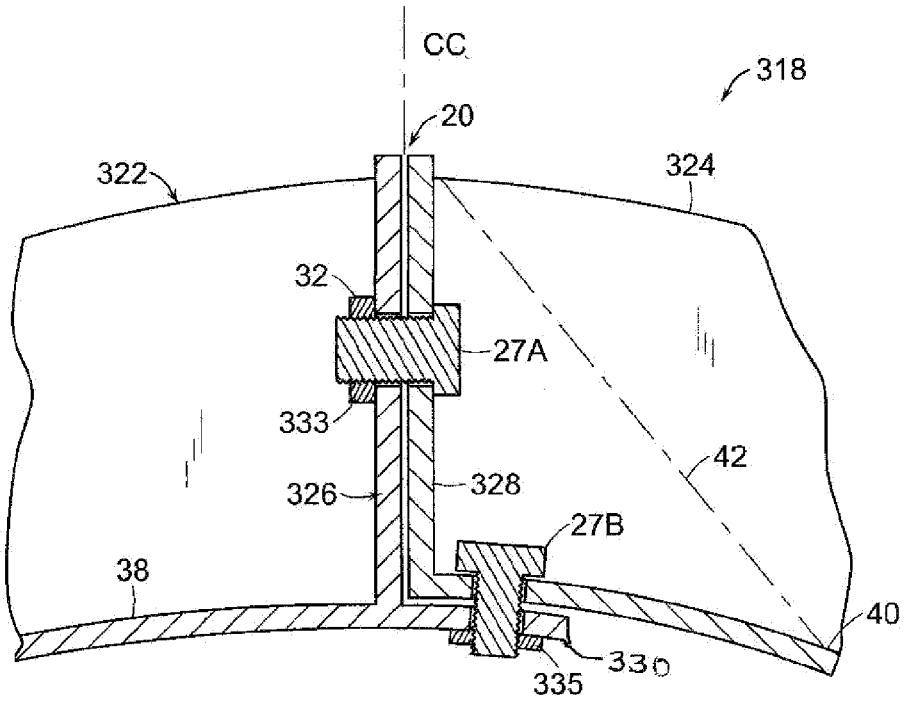
FIG. 5 is a view like FIG. 4, showing an alternative joint configuration which comprises fasteners.

FIG. 5 shows a portion of an alternate another embodiment of the invention, chamber 318, where a bolted joint 20 is formed between half chamber 322 and half chamber 324 —which half chambers have configurations largely like chambers 22, 24. A multiplicity of exemplary threaded fasteners 27A, 27B inserted in holes, and associated nuts 333, 335, are used to join vertical flanges 326, 328 to each other and to join lip 330 with valley 40. Preferably, a multiplicity of fasteners will be spaced apart along the length of the joint.

Figure 6:
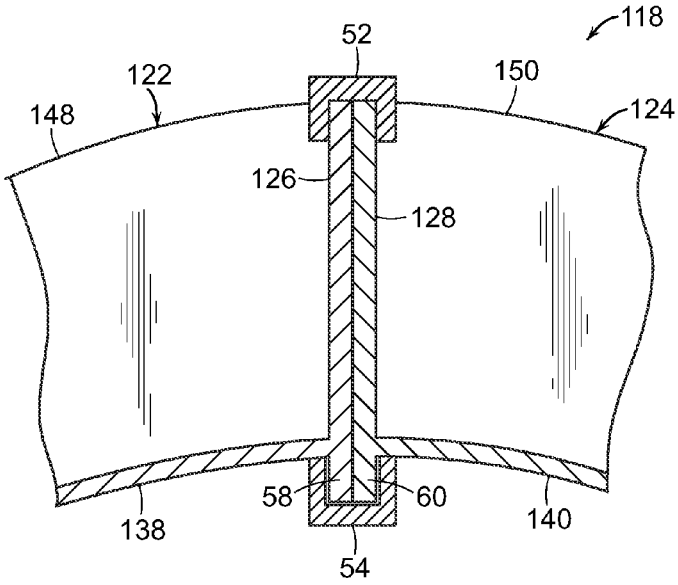
FIG. 6 is a view like FIG. 4, showing a chamber embodiment where C channels hold the mated half chambers to each other.
Figure 7:
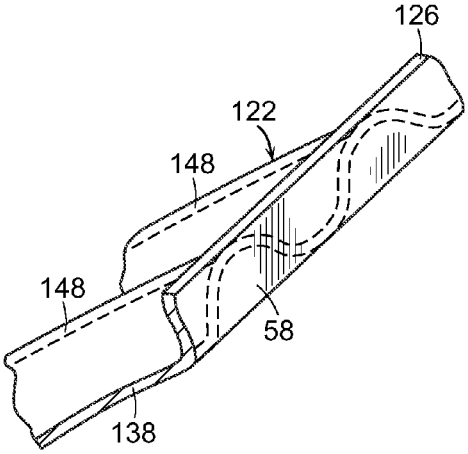
FIG. 7 is a partial perspective view of the top end of a half chamber, like that shown in FIG. 6.
Figure 8:
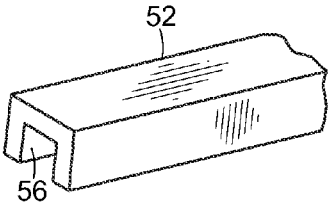
FIG. 8 is a perspective view of a channel which may be used to hold to half chambers together at a top joint.

FIG. 6 is a view like the view of FIGS. 4 and 5, showing a portion of another embodiment of the invention, chamber 118. Mating half chambers 122, 124 have respective peak corrugations 148, 150 and valley corrugations 138, 140. The half chambers 122, 124 meet at lengthwise flanges 126, 128. FIG. 7 is a partial view of the upper end of a half chamber 122, showing that flange 126 is preferably continuous, as is flange 128. In variations on this embodiment, the flanges may be intermittent as shown in connection with FIG. 3. Referring again to FIG. 6, lengthwise vertical lips 58, 60 run along the undersides of valleys 138, 140. The lips 58, 54 and the upper ends of flanges 126, 128 are respectively clamped together by channels 52, 54. FIG. 8 is a perspective view of typical channel 52 which is preferably made of a metal or fiber reinforced plastic. The width of channel 52 is dimensioned so that there is an elastic force in the channel when the clamp is forcibly engaged (as with a rubber hammer) with the mated flanges 126, 128. Channel 54 is similarly dimensioned with respect to the vertical lips 58, 60.

Figure 6A:
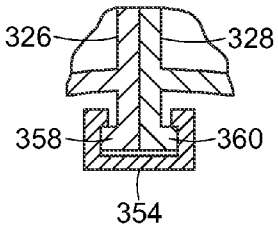
FIG. 6A is a partial detail of a variation on the joint shown in FIG. 6.

FIG. 6A is a detail of a portion of an alternative embodiment of the joint shown in FIG. 6. Flanges 326, 328 correspond with flanges 126, 128. The lengthwise vertical lips 358, 360 are L shape in cross section, so that when mated as shown they present as a T shape cross section. Alternate embodiment channel 354 is C shape in cross section, so it is vertically captured in place by the T shape cross section.

Figure 6B:
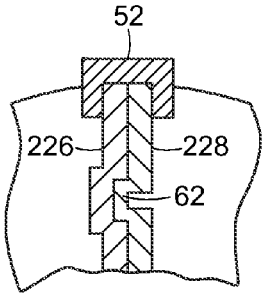
FIG. 6B is a partial detail of another variation on the joint shown in FIG. 6.

FIG. 6B shows another variation which may be used with the FIG. 6 embodiment and other embodiments. Vertical flange 226 has a recess and vertical flange 228 has a protuberance 62 which fits in the recess. The recess and protuberance may be round as shown in FIG. 3, or may comprise lengthwise running portions. In the chamber 118 and in other embodiments of the invention, the mating flanges may have even more contoured and interlocking features than have been shown by example.

Figure 9:
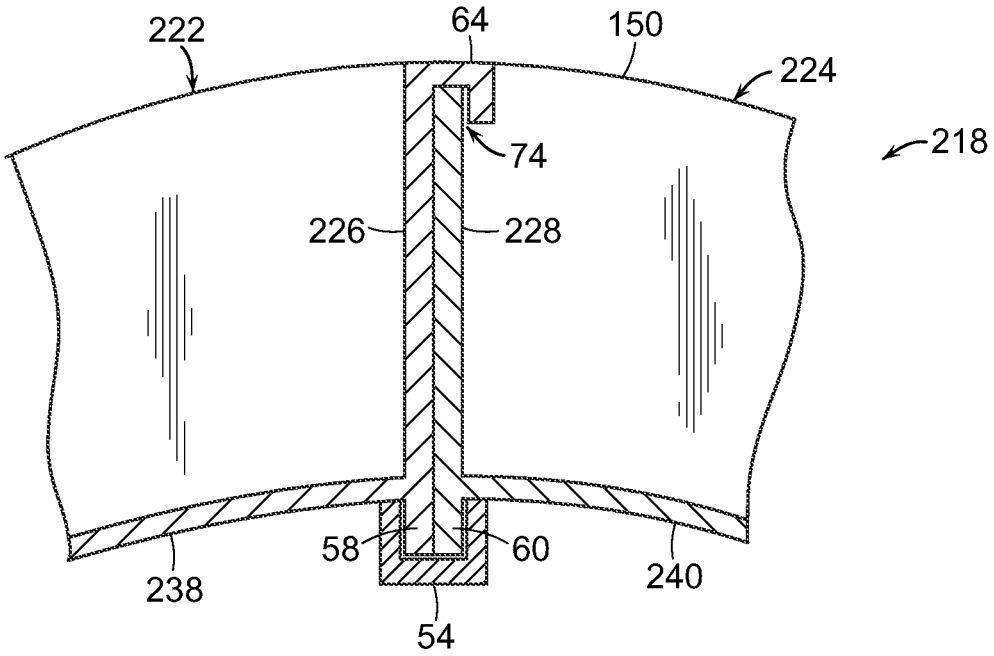
FIG. 9 is a view like FIG. 4 showing a joint comprising an integral J channel and a C channel clamp.

FIG. 9 is a vertical cross section like the view of FIG. 6, showing a portion of a chamber 218 comprised of half chambers 222, 224 having mating respective lengthwise vertical top flanges 226, 228, intermittent in valleys 238, 240. Alternately, the flanges are continuous. In the locations of the valleys, flange 226 has a top portion 64 shaped to create a pocket 74 within which is received the upper edge of flange 228. The upper part of flange 226 may be characterized as a J shape channel (which defines the pocket 74).

While the joint is preferably formed at the at the center plane of the chamber, as has been shown in several embodiments here, in the generality of the invention the joint may be offset transversely somewhat from the center plane; and thus the term half chamber in such instances would be construed in nominal and not exact terms.

In one method of making and shipping chambers within the scope of invention, when half chambers are molded, they may be mated and optionally welded in the factory and shipped as one piece chambers.

Figure 10:
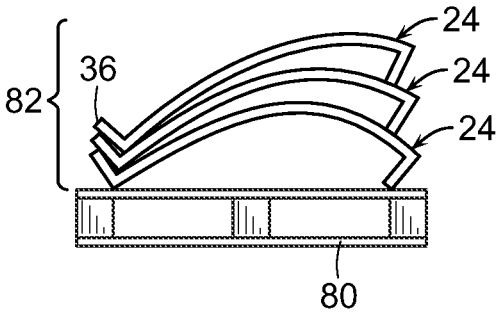
FIG. 10 is a semi-diagrammatic illustration of half chambers mounted on a pallet for shipping to an assembly point.

Alternatively, in another method of making and shipping chambers, half chambers may be shipped to an assembly point remote from the point of molding on a pallet 80 (or equivalent device) as a nested stack 82 as shown (for representative half chambers 24) in FIG. 10. Typically, a pallet with chambers in such transport configuration will be carried by a semi-trailer connected to a motor vehicle tractor truck. The point of assembly can be at the job site or in a vicinity of the job site where the less efficient transport of whole chambers is not a big economic factor. The following more completely states this process: A method of manufacturing and transporting an injection molded plastic corrugated chambers for receiving water when buried beneath the surface of the earth, wherein each chamber has a length, opposing side base flanges running lengthwise and lying in a base plane, an arch shape wall running upwardly to a chamber top from the opposing side base flanges, thereby the wall defining an arch shape cross section chamber interior, the wall characterized by alternating peak corrugations and valley corrugations running transverse to the chamber length, and a vertical center plane running intersecting the chamber top, comprises:

(a) injection molding a multiplicity of first half chambers and second half chambers, each half chamber comprising one of said base flanges, about half of said arch shape wall, and a coupling portion connected to the wall in vicinity of the top of a chamber which is formed by mating a first half chamber with a second half chamber; the coupling portions shaped for mating first half chambers with second half chambers to form whole chambers;

(b) placing the first half chambers and second half chambers on a pallet in nested fashion, transporting the pallets and said half chambers on a motor vehicle truck to a point of assembly;

(c) removing the half chambers from the pallet at the point of assembly;

(d) mating and securing the coupling portion of each first half chamber with and to the coupling portion of each second half chamber, to thereby form a multiplicity of whole chambers; and (e) placing each whole chamber with in a cavity in the earth for use.

The invention enables more compact and economic shipping, by shipping unassembled half chambers, compared to shipping whole chambers. The invention also enables fabrication of large chambers which are beyond the plastic-weight molding capacity of, or the platen size of, a particular injection molding press, where the half chamber is within such capacity.

The present invention has relationship with the invention of a commonly owned provisional application 61/700,315 of Moore, Jr. et al., and a non-provisional patent application claiming benefit of same, bearing Ser. No. 14/025,773, entitled "Molded Plastic Stormwater Chamber Having a Hinged Top Joint," filed on even date herewith. The disclosures of both applications are hereby incorporated by reference. The related applications describe chambers which are made from half chambers, where the half chambers are connected to each other by one or more hinge joints at the top of the chamber. Application Ser. No. 14/025,773 describes ways of locking one hinged half chamber to a mating hinged half chamber. The locking means, and in particular a longitudinal running locking rod, may be used in the present invention. The application also describes preferred ways of molding half chambers, so the resultant chambers are well-suited to overlapping end-to-end installations. That method of making may be used in the present invention.

The invention, with explicit and implicit variations and advantages, has been described and illustrated with respect to several embodiments. Those embodiments should be considered illustrative and not restrictive. Any use of words which relate to the orientation of an article pictured in space are for facilitating comprehension and should not be limiting should an article be oriented differently. Any use of words such as "preferred" and variations thereof suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A molded plastic corrugated chamber for receiving water when buried beneath the surface of the earth, the chamber having a length, an arch shape cross section, opposing lengthwise base flanges, and opposing sidewalls, each sidewall running curvingly upwardly from one of said base flanges to the top of the chamber, and each sidewall comprised of alternating peak corrugations and valley corrugations which run transverse to the chamber length;

the chamber comprised of a first half chamber and a second half chamber, each half chamber comprising one of said base flanges and one of said corrugated sidewalls, each half chamber having an upper end connected to the upper end of the other half chamber to form a lengthwise joint at the top of the chamber;

the first half chamber having a coupling feature comprising a plurality of vertical flanges at the upper end of half chamber, each flange running lengthwise along the chamber and across one of the valley corrugations;

the second half chamber having a coupling feature comprising a plurality of vertical flanges at the upper end of the half chamber, each flange running lengthwise along the chamber and across one of the valley corrugations;

wherein the coupling feature of the first half chamber is abutted with and connected to the coupling feature of the second half chamber to form said lengthwise joint.

2. The chamber of claim 1 wherein the first half chamber further comprises a serpentine lip running lengthwise along the upper end of the first half chamber and extending laterally with respect to said vertical flanges, the lip defining a plurality of spaced apart regions for receiving the upper end valley corrugations of the second half chamber; each valley corrugation of the sidewall of the second half chamber resting on one of said spaced apart regions of the serpentine lip.

3. The chamber of claim 2 wherein the upper end flanges of the first half chamber are attached to the upper end flanges of the second half chamber by one or more of welds, bolt fasteners, and C-shape cross section clamps.

4. The chamber of claim 2 wherein the vertical flanges of the first half chamber each have one or more sockets and wherein the vertical flanges of the second half chamber each have a plurality of pins, wherein each said pin is positioned within one of the sockets.

5. The chamber of claim 2 wherein each spaced apart region of the serpentine lip of the first half chamber has one or more engagement features, and wherein the downward facing surface of each valley corrugation of the second half chamber has one or more engagement features, wherein the engagement features of the first half chamber are mated with the engagement features of the second half chamber.

6. The chamber of claim 5 wherein the engagement features on the serpentine lip of the first chamber are protuberances and the engagement features of on the valley corrugations are a recesses.

7. The chamber of claim 6 wherein said flanges of the first half chamber are welded to the vertical flanges of the second half chamber.

8. The chamber of claim 1 wherein (a) the coupling feature of the first half chamber further comprises a plurality of flange lip portions, each portion extending downwardly from one of said vertical flanges, and (b) the coupling feature of the second half chamber further comprises a plurality of flange lip portions, each portion extending downwardly from one of said vertical flanges; further comprising: a plurality of C-shape cross section clamps engaged with said downwardly extending lip portions.

9. The chamber of claim 8 wherein said downwardly extending lip portions have an L-shape cross section.

10. The chamber of claim 1 wherein the first half chamber coupling feature further comprises a plurality of second vertical flanges, each running lengthwise along the chamber and across a peak corrugation at the upper end of the first half chamber, wherein each second vertical flange is connected to an abutting first vertical flange, to form a continuous vertical flange structure at the top of the first half chamber; and wherein the second half chamber coupling feature further comprises a plurality of second vertical flanges, each running lengthwise along the chamber and across a peak corrugation at the upper end of the second half chamber, wherein each second vertical flange is connected to an abutting first vertical flange, to form a continuous vertical flange structure at the top of the first half chamber.

11. The chamber of claim 10 wherein (a) the coupling feature of the first half chamber further comprises a plurality of flange lip portions, each portion extending downwardly from one of said vertical flanges, and (b) the coupling feature of the second half chamber further comprises a plurality of flange lip portions, each portion extending downwardly from one of said vertical flanges; further comprising: a plurality of C-shape cross section clamps engaged with said downwardly extending lip portions.

12. The chamber of claim 11 wherein said downwardly extending lip portions have an L-shape cross section.

13. The chamber of claim 11 further comprising a plurality of second clamps, each having a C-shape cross section, engaged with the topmost portions of said vertical flanges.

14. The chamber of claim 11 wherein the vertical flanges of the first half chamber each have one or more sockets and wherein the vertical flanges of the second half chamber each have a plurality of pins projecting laterally, wherein each said pin is positioned within one of the sockets.

15. The chamber of claim 1 wherein each first half chamber is substantially identical to each second half chamber.

16. A molded plastic corrugated chamber for receiving water when buried beneath the surface of the earth, the chamber having a length, an arch shape cross section, opposing lengthwise base flanges, and opposing sidewalls, each sidewall running curvingly upwardly from one of said base flanges to the top of the chamber, and each sidewall comprised of alternating peak corrugations and valley corrugations which run transverse to the chamber length;

the chamber comprised of a first half chamber and a second half chamber, each half chamber comprising one of said base flanges and one of said corrugated sidewalls, each half chamber having an upper end connected to the upper end of the other half chamber to form a lengthwise joint at the top of the chamber;

the first half chamber having a coupling feature comprised of plurality of vertical flanges at the upper end of half chamber, each flange running lengthwise along the chamber and across one of the valley corrugations; a serpentine lip running along the upper end of the half chamber and extending laterally with respect to said vertical flanges, the lip defining a plurality of spaced apart regions for receiving the upper end valley corrugations of the second half chamber; each vertical flange having one or more engagement features which is a socket or a pin;

the second half chamber having coupling feature comprised of a plurality of vertical flanges at the upper end of the half chamber, each flange running lengthwise along the chamber and across one of the valley corrugations; each vertical flange having one or more engagement features which is a pin or socket, each shaped for engaging a socket or pin of the first half chamber;

wherein the vertical flanges of the first half chamber are abutted with and connected to the vertical flanges of the second half chamber and wherein each valley corrugation of the sidewall of the second half chamber is resting on one of said spaced apart regions of the serpentine lip, and wherein the engagement features of the first half chamber are mated with the engagement features of the second half chamber.

17. The chamber of claim 16 wherein the upper end flanges of the first half chamber are attached to the upper end flanges of the second half chamber by one or more of welds, bolt fasteners, and C-shape cross section clamps.

18. A method of fabricating and transporting a multiplicity of injection molded plastic chambers adapted for receiving water when buried beneath the surface of the earth, each chamber having a transport configuration and a use configuration, wherein when in its use configuration each chamber has a length, an arch shape cross section, opposing lengthwise base flanges, and opposing sidewalls, each sidewall running curvingly upwardly from one of said base flanges to the top of the chamber, and each sidewall comprised of alternating peak corrugations and valley corrugations which run transverse to the chamber length; the chamber comprising a first half chamber and a second half chamber, each half chamber comprising one of said base flanges and one of said corrugated sidewalls, each half chamber having an upper end shaped for connection to the upper end of the other half chamber to form a lengthwise joint at the top of the chamber;

the first half chamber having a coupling feature comprised of a plurality of vertical flanges at the upper end of half chamber, each flange running lengthwise along the chamber and across one of the valley corrugations;

the second half chamber having a coupling feature comprised of a plurality of vertical flanges at the upper end of the half chamber, each vertical flange running lengthwise along the chamber and across one of the valley corrugations and shaped for mating a vertical flange of the first half chamber;

wherein when the chamber is in its transport configuration the half chambers are not attached to each other; and, wherein when the chamber is in its use configuration, the vertical flanges of the first half chamber are abutted with and connected to the vertical flanges of the second half chamber to form said lengthwise joint;

which method comprises:

a) injection molding a multiplicity of first half chambers and second half chambers, each half chamber comprising one of said base flanges, one of said corrugated sidewalls; and a coupling feature at the upper end of the corrugated sidewall;

(b) placing the first half chambers and second half chambers on a pallet in nested fashion, and transporting the pallets and said half chambers on a motor vehicle truck to a point of assembly;

(c) removing the half chambers from the pallet at the point of assembly; and, (d) mating each first half chamber with each second half chamber so the coupling features mate, and connecting the coupling features to each other, to thereby form a multiplicity of chambers in use configuration.

19. The method of claim 18 wherein the coupling features are connected to each other by using one or more of welding, bolting, and clamping with one or more C-shape cross section clamps.

20. The method of claim 18 wherein the coupling feature of a first half chamber comprises a serpentine lip running lengthwise at the top of a first half chamber which lip follows the contour in the vertical plane of said alternating peak corrugations and valley corrugations.

* * * * *